United States Patent [19]

Grote

[11] Patent Number: 4,616,699

[45] Date of Patent: Oct. 14, 1986

[54] WICK-FIN HEAT PIPE

[75] Inventor: Michael G. Grote, Maryland Heights, Mo.

[73] Assignee: McDonnell Douglas Corporation, St. Louis, Mo.

[21] Appl. No.: 568,295

[22] Filed: Jan. 5, 1984

[51] Int. Cl.[4] ..... F28D 15/00

[52] U.S. Cl. ..... 165/104.26; 122/366

[58] Field of Search ..... 165/104.26; 122/366

[56] References Cited

U.S. PATENT DOCUMENTS

| | | | |
|---|---|---|---|
| 3,152,774 | 10/1964 | Wyatt | 244/1 |
| 3,498,369 | 3/1970 | Levedahl | 165/105 |
| 3,525,670 | 8/1970 | Brown | 165/104.26 |
| 3,603,382 | 9/1971 | Paine et al. | 165/105 |
| 3,613,778 | 10/1971 | Feldman, Jr. | 165/104.26 |
| 3,734,173 | 5/1973 | Moritz | 165/104.26 |
| 3,735,806 | 5/1973 | Kirkpatrick | 165/105 |
| 3,811,496 | 5/1974 | Asselman et al. | 165/105 |
| 3,913,664 | 10/1975 | Roukis et al. | 165/104.26 |
| 4,105,895 | 8/1978 | Kennedy | 219/326 |
| 4,116,266 | 9/1978 | Sawata et al. | 165/105 |
| 4,274,479 | 6/1981 | Eastman | 165/104.26 |

FOREIGN PATENT DOCUMENTS

| | | | |
|---|---|---|---|
| 559099 | 5/1977 | U.S.S.R. | 165/104.26 |
| 649938 | 2/1979 | U.S.S.R. | 165/104.26 |
| 659882 | 4/1979 | U.S.S.R. | 165/104.26 |
| 987357 | 1/1983 | U.S.S.R. | 165/104.26 |

*Primary Examiner*—Albert W. Davis, Jr.

*Attorney, Agent, or Firm*—Gravely, Lieder & Woodruff

[57] ABSTRACT

A wick-fin heat pipe for increasing the performance of heat pipe evaporators and condensers having extended areas with high thermal conductivity material which increase the heat transfer and decrease the temperature drop. The wick-fin heat pipe provides transporting large amounts of heat with small temperature drop and is capable of accommodating large heat fluxes.

7 Claims, 6 Drawing Figures

WICK-FIN HEAT PIPE

BACKGROUND OF THE INVENTION

1. Field of the Invention

The present invention pertains to improvements in heat pipes adapted to transport large amounts of heat over long distances with small temperature loss in the process 2. Description of the Prior Art The need for improved heat transfer devices is exhibited most urgently in handling temperature problems in satellites employing solar cell arrays that are periodically subjected to sunlight and darkness where extremes of shifts in temperature exist. It is appreciated that in sunlight high temperatures can cause problems of structural integrety maintenance, and in darkness equally damaging cold temperatures are encountered.

One solution for the heat-cold cycles is presented in Wyatt U.S. Pat. No. 3,152,774 of Oct. 13, 1964 where the cyclic extremes in temperature are controlled within tolerable limits by utilizing the latent heat properties of certain materials, particularly the latent heat of vaporization. The construction proposed in this patent uses sufficient metal only for structural purposes and the desired thermal capacity is obtained by using a fluid coolant material such as water, methyl chloride, or one of the Freons. The thermal capacity is supplied by the specific heat of the fluid, and importantly by the heat of fusion or by the heat of vaporization thereof. The function of heat control is carried out with a textile, flock or fibrous material which acts as a wick to transfer fluid to the high heat zones for vaporization and to zones of low temperature for condensation to the fluid state. The wick material is carried in light weight metallic structure, and the wick material is interrupted or is not intended to be continuous.

Another version of a heat pipe is disclosed in Kirkpatrick U.S. Pat. No. 3,735,806 of May 29, 1973 but in this device thermal energy is moved only in one direction corresponding to the gravitational force acting thereon. The transfer of thermal energy is by the convection process in one direction in which the exposed surfaces are thermally insulating and the internal structure has insulating properties and capillary structure has a high thermal impedance and becomes an isothermal evaporator.

Other devices in the heat pipe class are Eastman U.S. Pat. No. 4,274,479 of June 23, 1981; Asselman et al U.S. Pat. No. 3,811,496 of May 21, 1974; Paine et al U.S. Pat. No. 3,603,382 of Sept. 7, 1971 and Levedahl U.S. Pat. No. 3,498,369 of Mar. 3, 1970.

SUMMARY OF THE INVENTION

In accordance with the construction characteristics hereinafter to be disclosed, this invention is directed to the wick-fin heat pipe for substantially increasing the performance of heat pipe evaporators and condensers which are particularly useful for installations with large surface heat fluxes, of the order of from 20 to 100 watts per square centimeter, or for lower fluxes where high heat transfer coefficients are required.

The objects of the invention are to provide wick-fins having extended areas with a high thermal conductivity material, generally over 60 w/m/°C., to increase the heat transfer; to provide wick-fins to increase the allowable wall heat fluxes before nucleate boiling limits are reached by reducing local fin flux; to provide wick-fins which decrease the temperature drop because of increased effective area; and to provide wick-fins which increase the wicking performance by decreasing the wick pressure loss because of the increased wick flow area.

It is also an important object to provide a device for transporting large amounts of heat over long distances with small temperature drop, such as equipment that requires heat transport devices capable of accommodating large heat fluxes expressed in terms of watts per square centimeter of area. Such devices are classified as heat pipes which transport heat with small drops in temperature. The heat flux capacity of heat pipe evaporators and condensers of current designs is limited by the heat pipe wall area. In conventional designs evaporation or condensation takes place at the inner wall area where the meniscus attaches to the groove wall. The wick-fin is designed to overcome these current limitations.

DESCRIPTION OF THE EMBODIMENTS

Figure 1:
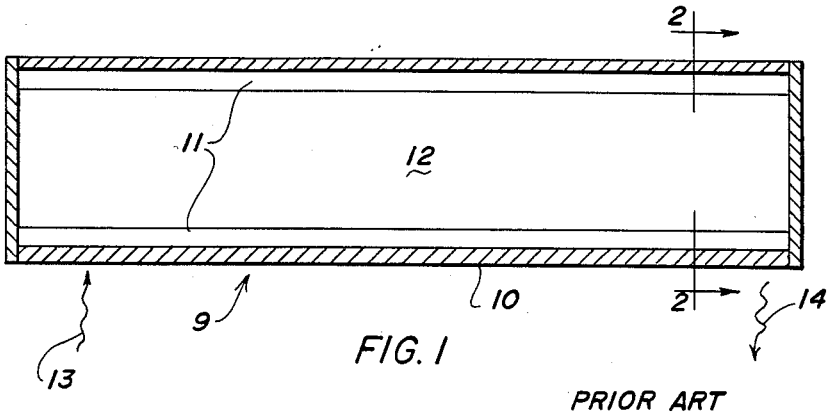
FIG. 1 is a longitudinal sectional view of a generally conventional heat pipe having grooves in the side wall.
Figure 2:
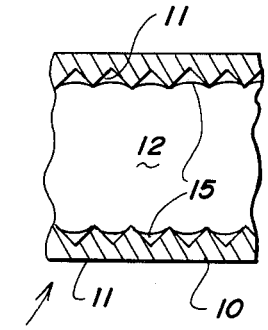
FIG. 2 PRIOR ART
FIG. 2 is a fragmentary transverse sectional view taken at line 2—2 in FIG. 1 to illustrate the meniscus type capillary wick effect.

The conventional prior art heat pipe 9 is seen in FIGS. 1 and 2 in which the wall 10 of the heat pipe enclosure is formed with full length V-shaped grooves 11 on the top and bottom so the central area 12 is open. If the heat input occurs at the left end shown by arrow 13, then the heat output condenser is at the opposite end shown by arrow 14. The heat pipe functions to transport the fluid in the V-shaped grooves from the condenser end where heat is released to the evaporator end where heat input evaporates the fluid and the vapor is then moved through the center 12 to the condenser end. Thus, in the prior art conventional heat pipe in FIGS. 1 and 2 with axial grooves evaporation or condensation takes place at the inner wall area where the fluid meniscus 15 attaches to the groove wall where the V-shaped grooves 11 are capillary wicks without presenting extended heat transfer surfaces. Thus, increased fluxes across this grooved area will normally result in large temperature drops. It is recognized that temperature drop can be reduced by providing finer grooves, but there are practical limits to how small the grooves can be made. When the heat flux increases nucleate boiling may occur which will block the capillary pumping in a zero-g environment, meaning that the heat pipe will burn out.

Figure 3:
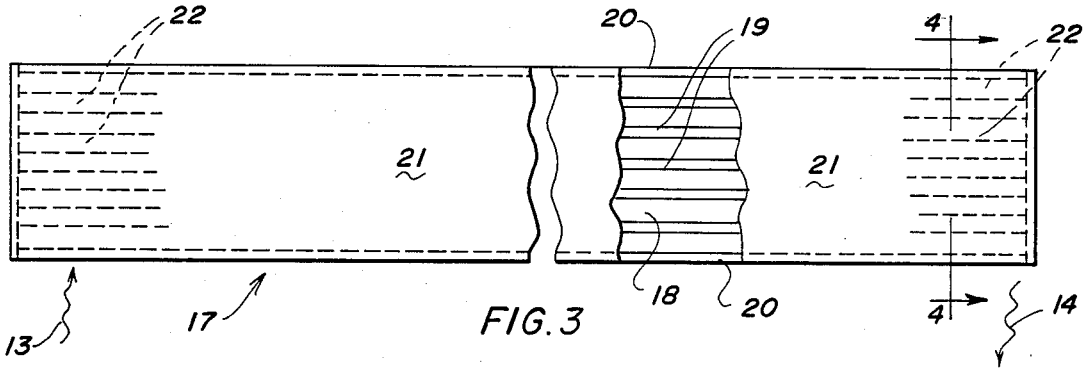
FIG. 3 is a plan view of a heat pipe having the characteristics of the present wick-fin construction, the view being shortened and partly broken out to reveal details.
Figure 4:
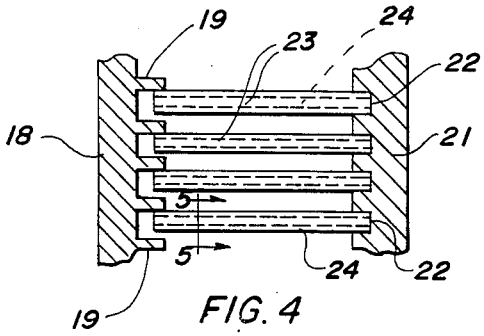
FIG. 4 is a fragmentary transverse sectional view taken along line 4—4 in FIG. 3 to show further characteristics of the wick-fin construction.
Figure 5:
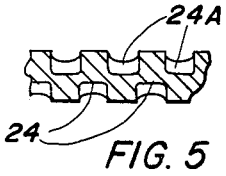
FIG. 5 is a fragmentary sectional view of a typical wick-fin showing one example of the wicking.

Turning now to FIGS. 3 and 4 there is shown a wick-fin heat pipe 17 incorporating the characteristics of the present invention. The heat pipe 17 of FIG. 3 is a casing forming a flat plate sealed enclosure or chamber having a bottom wall 18 provided with raised ribs 19 forming capillary grooves spaced apart and extending throughout the length of the pipe 17. In place of the ribs 19 which form capillary paths alternate means can be made of felt, metals, screens or similar means. There are side walls 20 and a top wall 21 spaced above the bottom wall by the side walls 20. Each end zone of the heat pipe 17 is provided with spaced grooves 22 which receive the ends of a group of wick-fins 23 which have grooves 24 on each side. The term 'wick-fin' refers to the formation at each end of the pipe 17 of elements 23 which in practice are fins (see FIG. 4) that transfer heat into or out of the wall 21. The elements or fins 23 have grooves 24 formed on both surfaces to function as wicks for the liquid medium. The wick-fins 23 are attached in the grooves 22 of the top wall 21 and act to increase the heat transfer area. The wall of FIG. 5 illustrates the typical arrangement of wicking grooves 24 formed on the opposite surfaces of the fins 23. While the grooves 24 are staggard, they do not have to be so arranged.

The heat pipe 17 in FIG. 3 is intended to receive heat input (arrow 13) at the left end and to give up heat (arrow 14) at the right end. The working medium in the heat pipe travels in vapor form through the central open space from left to right, and flows in fluid form through the capillary grooves between the raised ribs 19. The working medium may be methanol, water, any of the Freons, or ammonia, or any other appropriate working fluid, like liquid metals, sodium or potassium. The body of the heat pipe 17 is made from metals having a high heat conductivity factor (typically greater than 60 w/m°C.). In one heat pipe analysis example the height of the wick-fins 23 was about one centimeter and there were about 10 fins per centimeter with about 40 grooves 24 per centimeter on both sides. The working media was methanol, in such quantity as to fill the grooves 19 and 24. The media in grooves 24 presents a meniscus 24A, as shown in FIG. 5. A typical performance comparison of a conventional heat pipe evaporator and a wick-fin heat pipe evaporator, employing methanol at about 25° C. produced the following values.

| Performance | Conventional | Wick-Fin |
|---|---|---|
| Wicking limit heat flux Watts per square centimeter area | 25 | 390 |
| Effective heat transfer Coefficient | 0.57 | 6.20 |
| Temperature difference between wall and vapor at 50 Watts per square centimeter | 88° C. | 11° C. |

Wick-fins shown in FIGS. 4 and 5 are able to significantly decrease the evaporator and condenser temperature drop and can accommodate higher evaporator wall heat fluxes. The heat transfer fins 23 are attached to the wall grooves 22 to increase the heat transfer area. The fins are wicked, as at 24 by grooves, although screens, sintered metal and other wicking can be employed to capillary pump the working fluid through the central wicks 19 to the finned heat transport surface. As noted above, the central wicks 19 may be felt, metals, screens, or similar means. The advantages of the wick-fin heat pipe over the more conventional heat pipe are: for a given wall heat flux, the larger heat transfer area will reduce the temperature drop between the wall and the vapor; the larger area will reduce the local heat flux on the fin and will allow much higher heat fluxes on the wall before nucleate boiling limits are reached; the larger area will spread the capillary flow over more flow paths which will decrease the pressure drop and thus increase the wicking capacity; and the central fluid transport wick is isolated from the primary heat transport surface which will reduce or eliminate nucleate boiling problems in the central wick.

The effective heat transfer area of a wick-fin is the total fin surface area (AFin) times the fin effectiveness ($\eta$). The gain factor (x) of the wick-fin concept is the effective heat transfer area of the wick-fin divided by the area of the heat pipe wall. This is expressed as:

$$x=\eta AFin/AWall$$

The gain factor can be used to compare the wick-fin concept to a conventional concept with no fin, whereby the temperature drop in a wick-fin device is $$(TWall\text{-}TVapor)\ \text{Wick-fin}=x(TWall\text{-}TVapor)\ \text{No Fin}$$

Likewise, the maximum wall heat flux can be increased $$(q/A)\ \text{wall}=x(q/A)\ \text{max}$$

where (q/A) max=Maxium heat flux before nucleate boiling is initiated.

Figure 6:
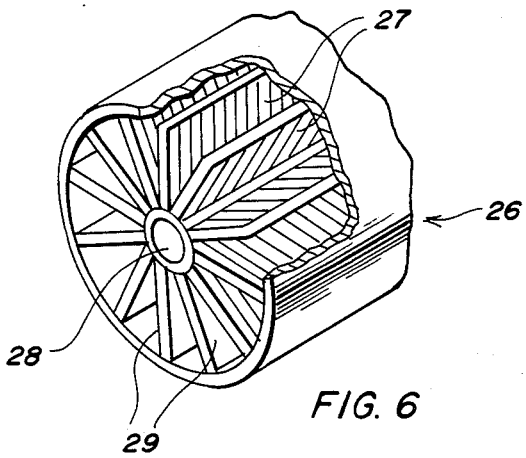
FIG. 6 is a fragmentary perspective view with a wall broken away to show the internal wick-fin construction in a tubular heat pipe.

What is desired in the heat pipe of FIGS. 3 and 6 is to provide thermal wick-fins of the class of materials, like copper and aluminum, having low thermal impedence (e.g. high thermal conductivity) with a large number of fins per centimeter and of a length to obtain the net increase in heat transfer performance. Such a heat pipe will transfer heat in both directions and will operate in either a zero-g or earth gravity field.

The herein disclosed heat pipe is suitable for space craft thermal control, as it has increased heat transfer capability to handle high heat flux needs. It is also capable of use to reduce temperature gradients between critical electronic components and performs as a heat sink in order to increase system reliability with minimal weight penalty for temperature control. Moreover, it is adaptable for use in aerothermodynamic systems such as may require a fluid film system to absorb laser energy.

While the foregoing disclosure relates mostly to the form of the heat pipe seen in FIGS. 3, 4 and 5, it also pertains to the form of the heat pipe seen in FIG. 6 where a tube 26 houses radially directed wick-fin panels 27 which radiate out from a central fluid transport wick 28. Vapor passages are provided by the pie-shaped spaces 29 between the several panels 27.

It is understood that in a zero-g field the heat pipes of FIGS. 3 and 6 do not have to be oriented in any particular position, but in the earth gravity field they function best when the vapor and fluid passages are substantially horizontal. The uniqueness of this invention resides in a heat transfer fin which significantly increases the effective heat transfer area from the fins rather than from the heat pipe wall, and in fins having integral wicking which draws fluid from a central fluid transport wick through capillary pumping so as to isolate the central wick from the primary heat transfer surface which is in the fins. These unique features result in a significantly improved heat pipe in that a lower heat pipe temperature drop is possible, and an ability to accommodate higher wall heat fluxes before nucleate boiling is initiated.

What is claimed is:

1. A heat pipe device comprising:

(a) a housing providing an elongated closed chamber havng closed ends;

(b) heat transfer fins in said closed chamber, each fin being characterized by having wicking grooves on opposite surfaces thereof, and said finss being arranged in longitudinally spaced groups with a group thereof being positioned adjacent each end of said closed chamber and providing extended heat transfer surfaces;

(c) heat transfer medium in said chamber capable of existing in liquid form upon giving up heat and existing in vapor form upon absorbing heat; and (d) wicking means in said chamber extending longitudinally in the closed chamber between said spaced groups of heat transfer fins for transferring the liquid form of said medium from one group of fins to another group thereof.

2. The heat pipe of claim 1 wherein each of said spaced groups of heat transfer fins present extended heat transfer surfaces combining capillary structure having a high heat transfer coefficient.

3. The heat pipe of claim 2 wherein said groups of heat transfer fins are formed from low impedence thermal materials of the class which include copper and aluminum.

4. A heat pipe comprising:

(a) an elongated housing having spaced side walls and closed ends sealing an axially elongated open space defining a vapor flow path between said side walls and extending between said opposite closed ends;

(b) a group of heat conducting fins spaced apart and projecting inwardly from one heat transfer wall of said housing adjacent each of said closed ends, said fins having a length less than the length of said housing and a surface area greater than the one wall from which they project said surface area being constituted by a plurality of capillary grooves on both sides of said fins;

(c) transport wicking on a second housing wall opposite said one heat transfer wall, said wicking forming capillary paths extending axially the length of said housing and in substantial alignment with and adjacent the vapor flow path and having ends adjacent said heat conducting fins; and (d) a heat transfer medium in said housing capable of conversion between liquid and vapor forms, said medium being converted into its vapor form by absorbing heat from one of said groups of heat conducting fins adjacent one closed end upon movement of the vapor form through said housing open space and being converted into its liquid form by giving up heat to another of said groups of heat conducting fins adjacent an opposite closed end, said axially extending transport wicking receiving the liquid form of said medium for capillary transport to said heat conducting fins adjacent said one closed end.

5. The heat pipe of claim 4 wherein said heat conducting elements are formed of a low impedence material to provide high thermal conductivity.

6. The heat pipe of claim 4 wherein said heat conducting elements have said grooves integrally formed thereon to produce capillary pumping from said transport wicking.

7. A heat pipe comprising:

(a) a closed housing having side walls and end walls defining an elongated open space extending from end to end between said side walls;

(b) groups of heat conducting elements extending from one of said side walls toward an opposite side wall and having outer ends approaching said opposite side wall, said groups of elements being located with one group adjacent each end wall so that said groups are spaced apart to leave an elongated open space between said groups of elements, said heat conducfing elements having capillary means on at least one sidewall thereof;

(c) transport grooves formed in said opposite side wall defining a plurality of wick surfaces, said grooves and wick surfaces extending lengthwise from end to end of said closed housing such that said groups of heat conducting elements approaching said opposite side wall penetrate into said transport grooves; and (d) a heat transfer medium in said housing capable of conversion between liquid and vapor forms, said medium being converted into its vapor form by absorbing heat from one of said groups of heat conducting fins adjacent one closed end upon movement of the vapor form through said housing open space and being converted into its liquid form by giving up heat to another of said groups of heat conducting fins adjacent an opposite closed end, said axially extending transport wicking receiving the liquid form of said medium for capillary transport to said heat conducting fins adjacent said one closed end.

* * * * *

UNITED STATES PATENT AND TRADEMARK OFFICE

CERTIFICATE OF CORRECTION

PATENT NO. : 4,616,699

DATED : October 14, 1986

INVENTOR(S) : Michael G. Grote

It is certified that error appears in the above-identified patent and that said Letters Patent is hereby corrected as shown below:

Column 5, line 11, "finss" should be "fins".

Column 6, line 13, "thermal" should be inserted after "impedence".

Column 6, line 30, "conducfing" should be "conducting".

Signed and Sealed this

Sixth Day of January, 1987

*Attest:*

DONALD J. QUIGG

*Attesting Officer*

*Commissioner of Patents and Trademarks*